US005980215A

United States Patent [19]

Robeller et al.

[11] Patent Number: 5,980,215

[45] Date of Patent: Nov. 9, 1999

[54] ADJUSTABLE HYDROSTATIC PUMP WITH ADDITIONAL PRESSURE CHANGE CONTROL UNIT

[75] Inventors: Walter Robeller, Boeblingen; Volkmar Leutner, Friolzheim; Dieter Bertsch, Neuhausen; Michael Gaumnitz, Kirchheim, all of Germany

[73] Assignee: Robert Bosch GmbH, Stuttgart, Germany

[21] Appl. No.: 08/875,485

[22] PCT Filed: Jan. 20, 1996

[86] PCT No.: PCT/DE96/00081

§ 371 Date: Jul. 8, 1997

§ 102(e) Date: Jul. 8, 1997

[87] PCT Pub. No.: WO94/24766

PCT Pub. Date: Aug. 15, 1996

[30] Foreign Application Priority Data

Feb. 9, 1995 [DE] Germany ..... 195 04 220

[51] Int. Cl.[6] ..... F04B 11/00; F04B 49/08

[52] U.S. Cl. ..... 417/219

[58] Field of Search ..... 417/221, 219; 92/72

[56] References Cited

U.S. PATENT DOCUMENTS

| | | | |
|---|---|---|---|
| 3,086,477 | 4/1963 | Ruhl | 103/161 |
| 4,185,540 | 1/1980 | Nonnonmacher et al. | 91/497 |
| 4,601,641 | 7/1986 | Kuroyanagi et al. | 417/220 |
| 4,711,616 | 12/1987 | Tsukahara et al. | 417/216 |
| 5,295,797 | 3/1994 | Kahrs et al. | 417/273 |
| 5,391,059 | 2/1995 | Hallundbaek | 417/27.3 |
| 5,651,301 | 7/1997 | Thoma et al. | 91/491 |
| 5,752,427 | 5/1998 | Leutner | 91/497 |

FOREIGN PATENT DOCUMENTS

| | | |
|---|---|---|
| 37 00 573 A1 | 7/1988 | Germany . |
| 91 04 126 U | 9/1992 | Germany . |
| 9104126 | 9/1992 | Germany . |
| 44 10 419 A1 | 10/1995 | Germany . |

*Primary Examiner*—Charles G. Freay
*Assistant Examiner*—Robert Z. Evora
*Attorney, Agent, or Firm*—Michael J. Striker

[57] ABSTRACT

An adjustable hydrostatic pump (10), in particular a piston pump, is proposed, whose cam ring (22) is adjustable via a hydromechanical adjusting assembly (35) and which has a device for active noise abatement. A pressure chamber (39) of a adjusting piston (37) acting upon the cam ring (22) is acted upon by pressure changes, via an additional control unit (47) parallel to the hydromechanical pressure controller (41), in such a way that the oscillating actions of power-train forces on the hydraulic fastening of the cam ring (22) are reduced, thus lessening the noise produced by the piston pump.

10 Claims, 3 Drawing Sheets

ADJUSTABLE HYDROSTATIC PUMP WITH ADDITIONAL PRESSURE CHANGE CONTROL UNIT

BACKGROUND OF THE INVENTION

The invention is based on an adjustable hydrostatic pump.

German Utility Model DE-GM Yt 04 126 discloses such a pump, in an embodiment as a radial piston pump, in which as the adjusting device, a cam ring is provided, whose eccentricity is considered the definitive variable for the pump adjustment or pump swiveling. The cam ring is retained in position by two different-sized hydraulic adjusting pistons, of which the larger adjusting piston is part of a hydromechanical adjusting assembly. The noise produced by such a piston pump is. very greatly dependent on the rigidity of the hydraulic fastening of the adjusting device, that is, the cam ring. The noise produced increases as the rigidity of the hydraulic fastening of the cam ring lessens and is caused by the components of the power-train forces acting in the direction of the adjustment. Depending on the rigidity of the fastening, this leads to a more or less pronounced deflection of the entire power train at the pace of the piston as it moves in and out of the pump pressure chamber. The noises that occur then may be annoying in some applications, where especially quiet operation is desired. Comparable conditions to the radial piston pump pertain to the axial piston pump as well, in which the adjusting device is embodied as a swash plate, and to a vane cell pump, which likewise has a cam ring as its adjusting device.

In a prior German patent application P 44 10 719.6, it has also already been proposed, in an adjustable radial piston pump, to provide active noise abatement, but here the adjustment of the cam ring is done via an electrohydraulic closed-loop control device. The intervention for noise abatement is done here via an electrohydraulic control valve, but many adjustable hydrostatic pumps lack such a valve.

From German patent disclosure OF 37 CO 573 A1, a radial piston engine is also known, in which an additional combustion chamber in the control journal can be charged from the high-pressure side via a throttled connection. As a function of the rotary position, the piston bore in the rotor is made to communicate briefly with this combustion chamber, and a rise in pressure is effected before this piston bore comes to communicate with the actual high-pressure control slit. In various cases, the noise reduction attendant on the lessening of the feed flow pulsation is insufficient, especially since the abrupt changes in force that occur as the piston emerges from the high-pressure side cannot be taken into account. No further description of the nature of the adjusting assembly is provided.

SUMMARY OF THE INVENTION

The adjustable hydrostatic pump of the invention, the advantage over the prior art that the noise produced by the pump is reduced substantially by lessening the influence of the components of the power-train forces that act on the hydraulic fastening of the adjusting device and counteracting them. By triggering the adjusting piston in the manner according to the invention, via an additional control unit with an additional pressure signal that is dependent on the rotary angle pf the pump, the power-train-dictated oscillations and hence the operating noise are favorably modified. This modification or reduction goes tar beyond anything that could be attained through the design of the adjusting device or of the adjusting pistons and adjusting assembly. The additional control unit for active noise abatement can be achieved using purely hydromechanical function elements, thus flaking a relatively simple, space-saving and economical design possible.

It is especially advantageous if the additional control unit is integrated with function elements that are already present anyway, so that the indicated noise reduction is attainable at very little additional expense. In this way, the requisite relative motion and the requisite synchronization already exist in the additional control unit. Especially effective noise abatement can be attained if the additional control unit controls a relief of the pressure chamber to the return line. Especially effective noise abatement can be attained in a radial piston engine. Other advantageous features will become apparent from the description, and the drawing.

BRIEF DESCRIPTION OF THE DRAWING

One exemplary embodiment of the invention is shown in the drawing and described in further detail in the ensuing description.

DESCRIPTION OF THE PREFERRED EMBODIMENT

Figure 1:
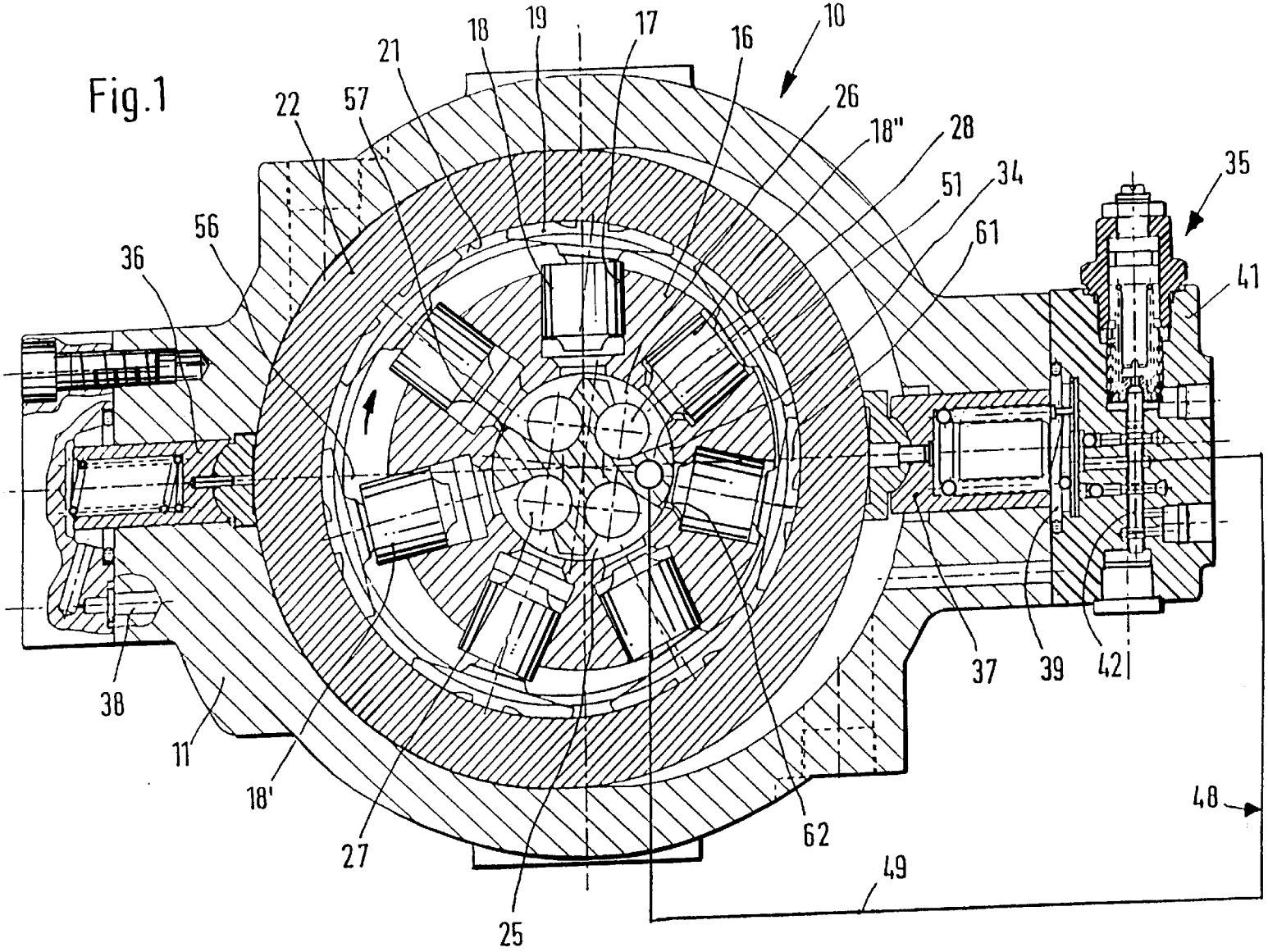
FIG. 1 shows a section through a clockwise-rotation radial piston pump.
Figure 2:
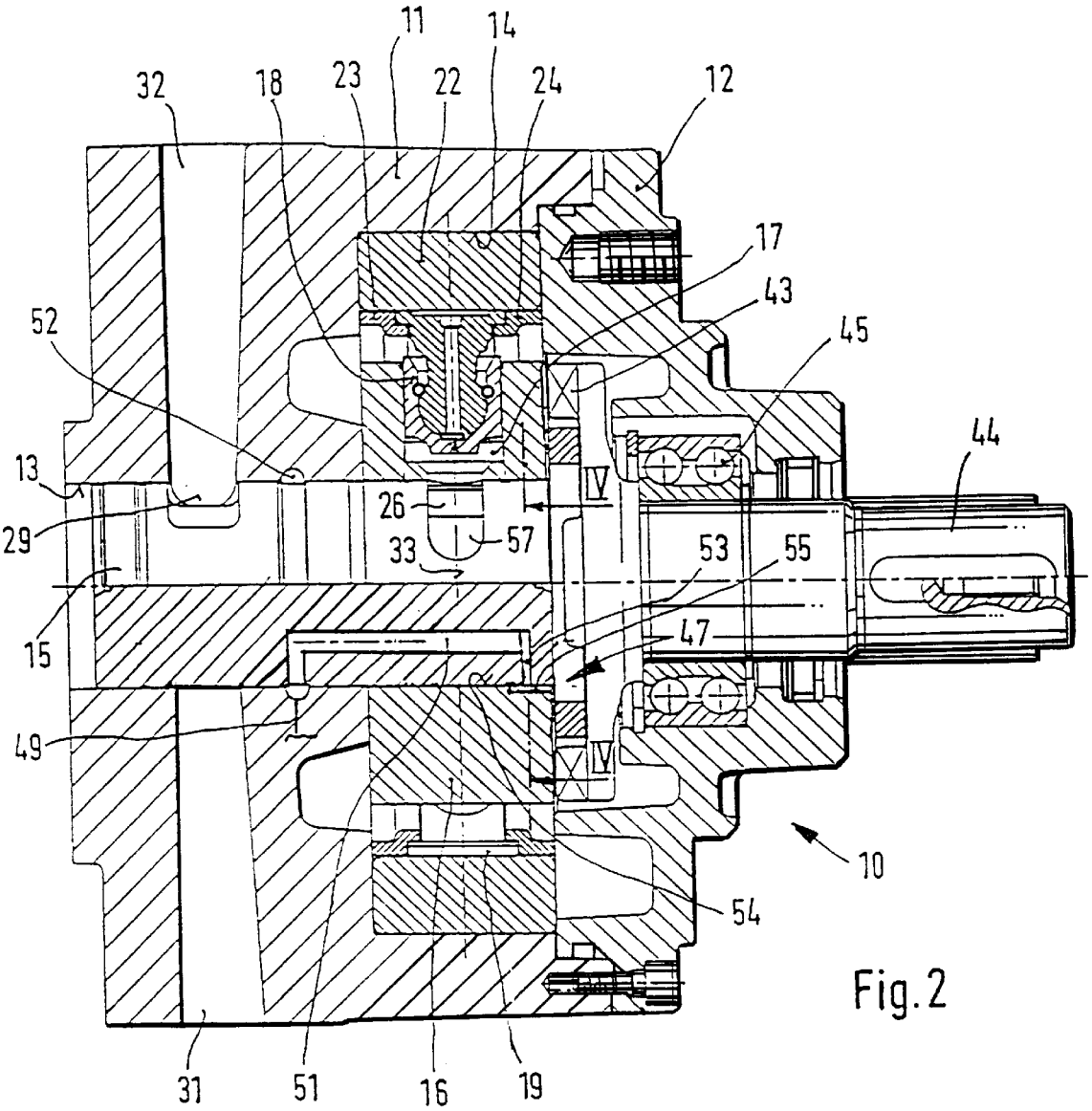
FIG. 2 shows a longitudinal section through the radial piston pump of FIG. 1.

FIG. 1, in combination with FIG. 2, shows a radial piston pump 10, whose housing 11 is closed on one side by a cap 12. A central, continuous longitudinal bore 13 and a cylindrical recess 14 adjoining it are embodied in the housing 11. A control pin 15 is secured in the longitudinal bore 13 and protrudes into the housing recess 14. A rotor 16 is slidingly supported on this portion of the control pin 15, and embodied in the rotor are a plurality of radially extending cylinder bores 17, in which work pistons 18 slide. This work pistons 18 are pivotably connected to slide blocks 19, which are supported by their bottoms on the inside face 21 of a cylindrical cam ring 22, which is disposed adjustably in the housing recess 14. Because of the eccentric position of the cam ring 22 acting as an adjusting device, which can be seen in FIG. 1, reciprocating motions are imparted to the work pistons 18. For binding the slide blocks 19 to the cam ring 22, retaining rings 23, 24 are provided.

In the control pin 15, in the plane of the piston bores 17, two control slots 25, 26 are formed, which via longitudinal conduits 27, 28, likewise. formed in the control pin 15, and openings, of which only the upper opening 29 is shown in FIG. 2, communicate with conduits that penetrate to the outside and that are embodied here as an intake conduit 31 and a pressure conduit 32. shown on the control pin 15 are the arms 33, 34, which are located between the control slots 25, 26 and on which the dead center points for the rotary motion are located.

The radial piston pump 10 is embodied with a hydraulic cam ring adjustment, which has a purely hydromechanical adjusting assembly 35. To that end, two different-sized adjusting pistons 36, 37 are disposed in the housing 11 and act on two. diametrically opposed points of the outer circumference of the cam ring 22. In a manner known per se, the smaller adjusting piston 36 is always acted upon via a conduit 38 from the high-pressure side 32. The larger adjusting piston 37 defines a pressure chamber 39, which communicates with the high-pressure side 32 via a pressure controller 41, which is flanged to the housing 11 and is blocked off from. its control slide 42, or is relieved to the low-pressure side 31, as is known per se in radial piston pumps with hydraulic cam ring adjustment.

The rotor 16, here embodied as a radial cylinder, is driven via a universal coupling 43 by a drive shaft 44, which is supported in the cap 12 in a double ball bearing 45.

Figure 4:
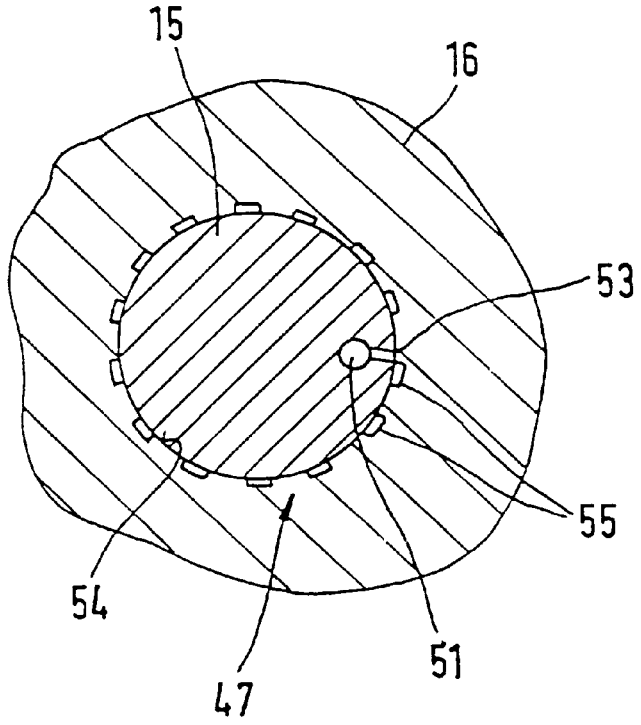
FIG. 4 is a fragmentary cross section taken along the line IV—IV of FIG. 2.

As shown in further detail in FIG. 1 in conjunction with FIGS. 2 and 4, the radial piston pump 10 has an additional control unit 47 for active noise abatement which is inserted into a control connection 48 that extends from the pressure chamber 39 of the large adjusting piston 37 to a return line in the housing 11. This control connection 48 is shown in part and in simplified form in FIG. 1 as a line 49, which begins at the pressure chamber 39 of the adjusting piston 37 and leads to an axial conduit 51 in the control pin 15. This line 49 extends inside the housing 11, in a manner not shown in further detail, and communicates with the axial conduit 51 via an annular groove 52 in the housing 11, as shown in further detail in FIG. 2. For the sake of simplicity in the drawing, this axial conduit 51 is shown rotated into the plane of the drawing in FIG. 2. From this axial conduit 51, a radial throttle bore 53 extends into the jacket face of the control [journal] pin 15, on which the radial cylinder 16 is supported. As FIG. 2 in conjunction with the fragmentary section of FIG. 4 shows in further detail, control grooves 55 are embodied in the radial cylinder 16, on its cylindrical inner wall 54, which cooperate with the throttle bore 53 and form the additional control unit 47. These axially extending control grooves 55 are open toward a drive-side end of the radial cylinder 16, thus creating communication with the return line in the housing 11. Each work piston 18 is assigned two of these control grooves 55, which are each located at the most favorable angular spacing from the particular work piston whose abrupt change in force is to be compensated for. As FIG. 4 shows in simplified form, the throttle bore 53 is closed off, outside the angular range of the control grooves 55, by the inner wall 54 of the radial cylinder 16. Since there are seven work pistons 18 in the radial cylinder 16, there are accordingly a total of fourteen control grooves 55 disposed in the inner wall 54.

Figure 3:
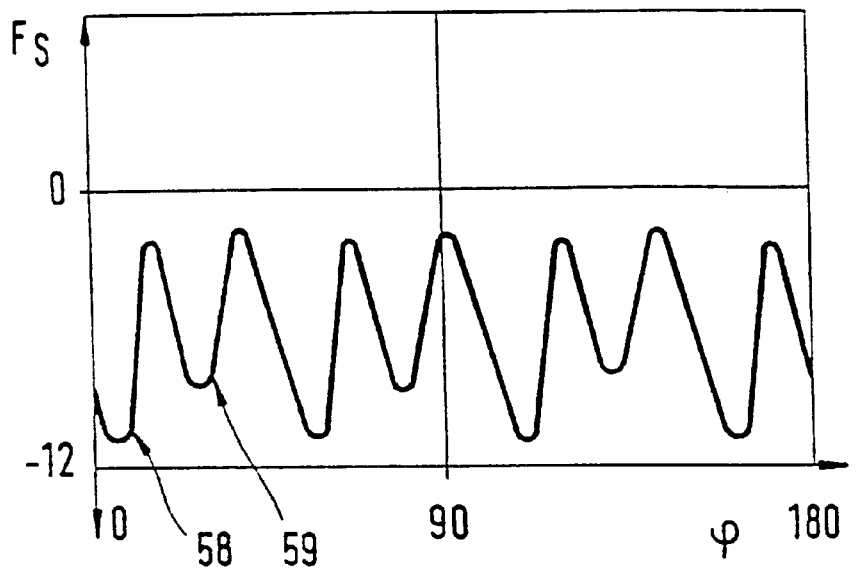
FIG. 3 is a graph that in highly simplified form shows the power-train force in the adjusting direction as a function of the rotary angle.

The mode of operation of the adjustable radial piston pump 10 will be explained as follows; its basic function, with the adjustment of the cam ring 22 by the hydromechanical adjusting assembly 35 is stipulated as being known per Se. In the clockwise-rotation radial piston pump 10 shown in FIG. 1, the cam ring 22 is deflected to the left via the adjusting assembly 35. The cam ring 22 is supported on the large adjusting piston 37, as a consequence of the power-train forces that have a centering effect. Each time one of the work pistons 18 plunges into or emerges from the high-pressure side at the control slot 26, the supporting force F5 on the adjusting piston 37 undergoes an abrupt downward change in the level of the piston force. This can be illustrated in conjunction with FIG. 1. When the work piston 18 in its clockwise rotation moves past the outer dead center 56 and changes over to its compression stroke, an increase in force or pressure, which is braced on the cam ring via the sliding block, occurs over the rotary angle that is approximately equivalent to the pilot control groove 57. A component of this bracing force, as the piston 18' plunges into the high-pressure side, presses the cam ring 22 to the left in terms of FIG. 1 and thereby relieves the large adjusting piston 37, whereupon the pressure in its pressure chamber 39 drops. This kind of abrupt change in the power-train force $F_s$ in the adjusting direction is plotted in greater detail in FIG. 3 over the rotary angle $\phi$, where this periodic force fluctuation occurs at 58. FIG. 3 shows a highly simplified and purely schematic course of force, in order to illustrate the situation in a previously known pump that lacks the arrangement according to the invention. If in FIG. 3 the first sudden force change 58 is associated with the piston 18', then the next sudden force change 49 in this curve is caused by the emergence of the work piston. 18" from the high-pressure side of the control slot 26. On the emergence of the work piston 18" and at the transition through the inner dead center to the intake stroke, the supporting force exerted outward by the work piston 18" on the cam ring 22 is reduced, which in turn lessens the adjusting force on the large adjusting cylinder 37. As FIG. 3 further shows, these abrupt changes in the adjusting force Fs occur at twice the piston frequency, so that a total of fourteen abrupt changes in force 58, 59 occur in one rotation of the rotor 16. These abrupt changes in force 58, 59 can be trimmed somewhat and lessened in magnitude by the pilot control grooves 57, 62 on the control pin 15, but this is not shown in FIG. 3 for the sake of clarity. The persistent remainder of the abrupt changes in force, however, because of the resilience of the hydraulic fastening, leads to oscillation of the cam ring 22, which causes some of the noise of the radial piston pump 10. To reduce this noise, a pressure change in the large adjusting piston 37 in synchronism with the abrupt changes in force is now brought about by the additional control unit 47, by opening and closing control cross sections. This additional control unit 47 is connected parallel to the actual pressure controller 41 itself. To that end, the additional control unit 47 is integrated with the rotor 16, with the aid of the throttle bore 53 in the control pin 15 and the control grooves 15, because in this way the requisite relative motion and synchronization already exist. When the abrupt change in force 58 at the large adjusting piston 38 occurs as the work piston 18' plunges into the high-pressure side 26, this is counteracted by the provision that the additional control unit 47 reduces the pressure in the pressure chamber 39. It is performed via the control connection 48 to the return line., in timely fashion so as to reduce the effect of the abrupt change in force 58. In a corresponding way, when the work piston 18" emerges from the high-pressure side 26, a control cross section to the return line is again opened by the additional control unit 47, and the pressure in the adjusting cylinder 39 is reduced, in order to lessen the effect of the abrupt change in force 59. In this way, the abrupt changes in force exerted Qn the adjusting pistons by the action of the power-train forces can be reduced considerably, which leads to a considerable drop in noise. The additional control unit, in its mode of operation, is adapted in such a way to the hydraulic cam adjustment that despite the delays due to the hydromechanical adjusting assembly, the timely arrival of both the abrupt change in force from the power train and its counteraction by the adjusting piston 37 is assured.

It is understood that changes in the embodiment shown are possible, without departing from the scope of the invention. The radial piston pump 10 can for instance be equipped with a combined pressure and current controller, instead of the pressure controller 41. The additional control unit 47 can also easily be modified in such a way that instead of the one throttle bore 53, there are two control recesses in the control journal 15, so that only seven control bores are needed on the inner wall of the rotor 16, or in other words, a number equal to the number of pump elements 18. The radial piston pump 10 can also be equipped with different hydromechanical adjusting assemblies and can be operated in different rotational directions. In other models of the radial piston pump, it may be necessary for the additional control unit to effect a pressure increase in the pressure chamber of the adjusting piston, so that the control connection is made to communicate not with the return line, but rather with a high-pressure side. This type of active noise abatement can also be adopted for axial piston pumps of the swash plate type, in which the additional control unit is integrated with the cylinder drum and the associated control disk. The noise abatement can also be employed in a vane cell pump, in which there is a cam ring adjustment comparable to that in the radial piston pump. In all these cases, a pronounced noise reduction is attainable at relatively little added expense by using function elements that are already present anyway.

We claim:

1. An adjustable hydrostatic pump, comprising a drive shaft; a housing; a rotor arranged in said housing and cooperating with said drive shaft, said rotor being provided with recesses; pump elements which are slidingly guided in said recesses and having ends which extend outwardly of said rotor; an adjusting device that generates reciprocation and with which said ends of said pump elements are braced; at least one adjusting piston which limits a pressure chamber; a hydraulic adjusting assembly which acts on said adjusting piston for adjustment purposes; a control body provided with control slots which are separated from one another and assigned respectively to a high-pressure side and a low-pressure side; and a hydromechanical additional control unit, which parallel to said adjusting assembly in said pressure chamber associated with said adjusting piston controls a pressure change in a correspondingly synchronized manner to abrupt force changes that occur at said adjusting piston.

2. An adjustable hydrostatic pump as defined in claim 1, wherein said additional control unit is formed by said rotor and said control body which are movable relative to one another.

3. An adjustable hydrostatic pump as defined in claim 1; and further comprising a control connection leading from said pressure chamber to a return line, said additional controlled unit being inserted into said control connection.

4. An adjustable hydrostatic pump as defined in claim 1, wherein said additional control unit has control grooves disposed in said rotor, each of said pump elements being assigned at least one of said control grooves relieved to a return line, said control grooves cooperating with at least one control recess structurally connected to said housing in said control body, said recess communicating with said pressure chamber, said control grooves and said control recess being adapted to one another as to their angular position in a rotary direction such that each time one of said pump elements plunges into and emerges from the high-pressure side, a control cross-section of said additional control unit is controlled.

5. An adjustable hydrostatic pump as defined in claim 1, wherein said adjusting device is formed as a cam ring in which work pistons are each disposed in radial bores of said rotor as pumping elements; and further comprising sliding blocks through which said pumping elements are braced on an inner circumference of said cam ring; a control pin on which said rotor is supported and which acts as said control body, said control pin having control slots located so as to communicate respectively with an intake conduit and a pressure conduit; two adjusting pistons having different diameters and acting on an outer circumference of said cam ring at diametrically opposed points, said adjusting pistons including a smaller adjusting piston which is continuously acted upon from the high-pressure side of the pump, and a larger adjusting piston which is communicatable with at least one of said sides via said hydromechanical adjusting assembly.

6. An adjustable hydrostatic pump as defined in claim 5, wherein said additional control unit has control grooves which are located in an inner wall of said rotor, distributed along a circumference, and are open toward one face end of said rotor, said control piston having an outer face provided with a control recess which is formed as at least one radial throttle bore and communicates with said pressure chamber on said larger adjusting piston via a conduit structurally connected to said housing.

7. An adjustable hydrostatic pump as defined in claim 6, wherein said rotor has seven pistons, said additional control unit having fourteen associated control grooves.

8. An adjustable hydrostatic pump as defined in claim 5, wherein said additional control unit is formed so as to form a pressure reduction in said pressure chamber in synchronism with abrupt changes in force.

9. An adjustable hydrostatic pump as defined in claim 1 as embodied in an axial piston pump of a swash plate type, wherein said rotor is formed as a cylinder drum, said adjusting device being formed as an adjustable swash plate, said control body being formed as a control disk, said additional control unit being integrated with said cylinder drum and said control disk.

10. An adjustable hydrostatic pump as defined in claim 1 and embodied as a vane cell pump, wherein said additional control unit is integrated with said rotor and a control plate on a face end.

* * * * *